US005163666A

United States Patent [19]

Kuo

[11] Patent Number: 5,163,666

[45] Date of Patent: Nov. 17, 1992

[54] SELF-ADJUSTING CLOSED-LOOP FRICTION FEEDER

[75] Inventor: Youti Kuo, Penfield, N.Y.

[73] Assignee: Xerox Corporation, Stamford, Conn.

[21] Appl. No.: 767,456

[22] Filed: Sep. 30, 1991

[51] Int. Cl.[5] ..... B65H 5/00

[52] U.S. Cl. ..... 271/10; 271/34; 271/110; 271/111; 271/116; 271/117; 271/121

[58] Field of Search ..... 271/10, 34, 110, 111, 271/117, 114, 116, 121, 124

[56] References Cited

U.S. PATENT DOCUMENTS

| | | | |
|---|---|---|---|
| 3,934,869 | 1/1976 | Strobel, Jr. | 271/35 |
| 3,966,189 | 6/1976 | Taylor et al. | 271/34 |
| 4,475,732 | 10/1984 | Clausing et al. | 271/10 |
| 4,561,644 | 12/1985 | Clausing | 271/34 |
| 4,572,498 | 2/1986 | Shiozawa | 271/34 |
| 4,750,726 | 6/1988 | Looney | 271/10 |
| 4,750,727 | 6/1988 | Looney | 271/110 |
| 4,900,003 | 2/1990 | Hashimoto | 271/114 |
| 4,934,684 | 6/1990 | Gysling | 271/34 |
| 5,006,903 | 4/1991 | Stearns | 355/308 |

FOREIGN PATENT DOCUMENTS 63-87436 4/1988 Japan .

*Primary Examiner*—H. Grant Skaggs
*Assistant Examiner*—Carol Lynn Druzbick
*Attorney, Agent, or Firm*—R. Hutter

[57] ABSTRACT

An apparatus feeds and separates sheets individually from a stack of sheets. A nudger is disposed adjacent to at least a portion of the stack, and a mechanism, including a rotatable friction feed belt thereon, is disposed adjacent a sheet on the stack to be fed. A variable normal force is provided between the nudger and the friction feed belt of the mechanism. A sensor detects a lead edge of a sheet at a preselected location relative to the mechanism, and the increase in the normal force between the mechanism and the nudger is stopped when the lead edge of a sheet is detected by the sensor.

27 Claims, 4 Drawing Sheets

FIG. 4
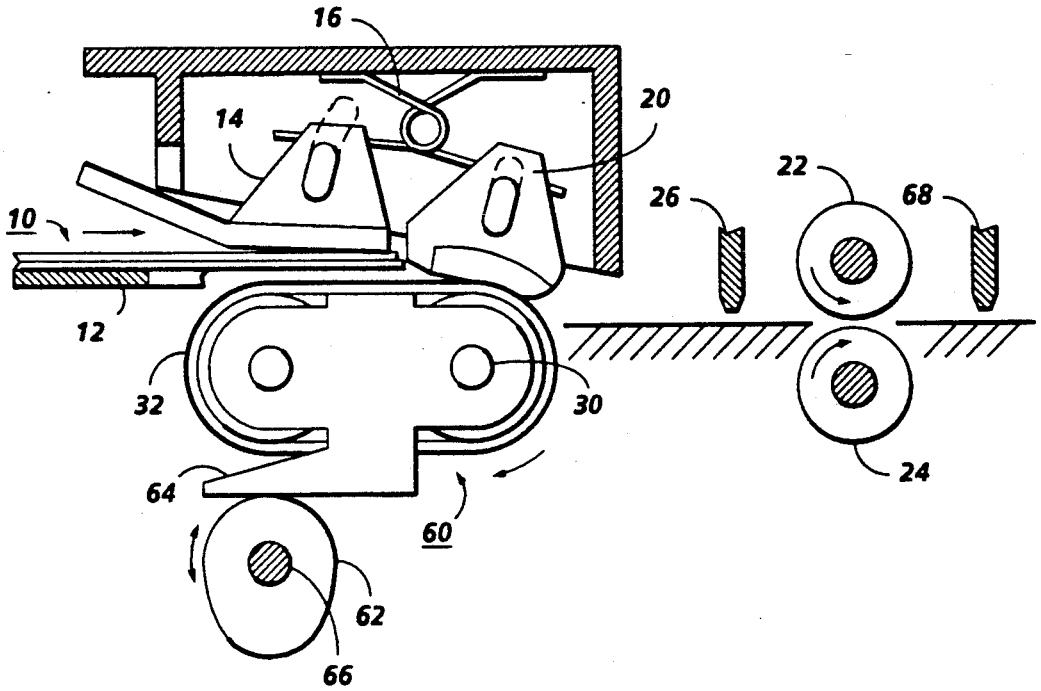
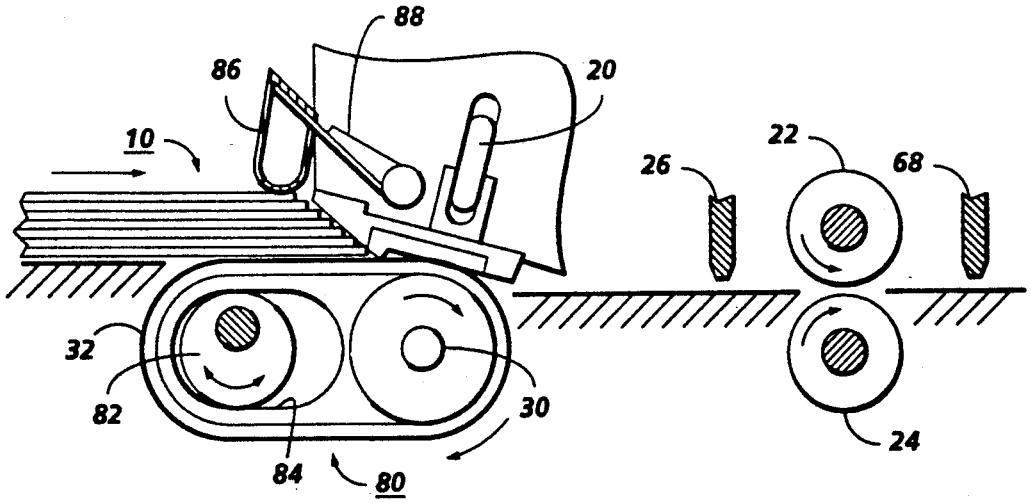
FIG. 5

SELF-ADJUSTING CLOSED-LOOP FRICTION FEEDER

FIELD OF THE INVENTION

The present invention relates to a sheet feeding and separating apparatus for feeding individual sheets from a stack, as, for example, in a high-speed or high-volume electrophotographic printer. More particularly, the present invention relates to a sheet feeding and separating apparatus which is self-adjusting in regard to the weights and surface characteristics of various types of sheets.

BACKGROUND OF THE INVENTION

A major problem associated with sheet-feed devices is feeding papers of various weights and surface characteristics. In high-speed photocopying machines, facsimile machines, and the like, individual sheets are separated from a stack for use in the image-forming process, either as documents to be copied or blank sheets upon which an image may be formed. This separation is commonly achieved by applying a normal force to the exposed surface of a sheet in the stack, and drawing the sheet off the stack by friction. In separating and feeding the individual sheets, two types of malfunction are of most importance: multifeeding, in which more than one sheet is drawn from the stack at one time, and misfeeding, in which no sheets are successfully drawn from the stack. Very often these and similar problems are caused by the application of too much or too little normal force to a sheet being separated from the stack.

In current use, most sheet feeders are designed specifically for a particular type or weight of paper having a narrow range of characteristics. However, in practice, a machine may be exposed to a wide variety of sheets, ranging from extremely heavy paper (110 lb. card stock) to extremely light paper such as onion skin (9 lb. or 8 lb. bond). If a feeder is designed to handle light paper, it is not likely to handle heavy stock reliably. Similarly, a feeder designed to handle heavy paper may severely mutilate lightweight paper such as onion skin.

In addition to misfeeding and multifeeding, another problem of document quality caused by an excessive amount of force applied to the sheet is smearing. The normal force applied to a document for purposes of feeding and separating is likely to smear the ink on the sheet. Heretofore, the smear problem has been regarded as an inherent property of friction feeders, as the "window" of permissible normal forces, which will avoid the alternative risks of misfeeding and smearing, is so small.

To obviate the problems caused by inappropriate amounts of force in friction feeders, a number of schemes have been proposed U.S. Pat. No. 4,475,732 to Clausing, et al., assigned to the assignee of the present application, discloses a system by which the normal force applied to the sheet on the stack to be separated is set at an initial high value, and is maintained at the initial high value until movement of the lead edge of the sheet to a certain location is detected. When movement of the sheet off the stack is detected, the normal force against the stack is momentarily relieved while the sheet continues to be drawn from the stack by take-away rolls. In this way, a large normal force insures that even the heaviest sheets will be drawn off the stack, but the large force is not applied long enough to damage the sheet.

U.S. Pat. No. 4,900,003 to Hashimoto discloses a sheet conveying apparatus in which a sheet to be conveyed is initially contacted by a pick-up roller, which is mounted on a reciprocating rocker member. The pick-up roller conveys the sheet to a separation roller, which urges the sheet against a separating plate. As described at column 7, lines 16–27 of the patent, the singularity of sheets being fed by the apparatus is achieved by maintaining a certain relationship of frictional coefficients among the sheet, the separation roller, and the separating plate.

U.S. Pat. No. 5,006,903 to Stearns discloses a sheet feeding apparatus wherein a feed belt disposed underneath a stack of sheets feeds the bottom sheet through a nip with a retard roller. The retard roller is braked by a motor which prevents motion of the retard roller when two sheets are in the nip.

Japanese patent 63-87436 discloses a medium (sheet material) delivering system in which a subroller disposed at the bottom of a stack of sheets is brought into contact with the bottom sheet. The subroller is coupled to a main roller by a delivery belt. The bottom sheet is moved from the stack by the delivery belt until it is caught by a pair of feed rollers, which continue moving the sheet. When the leading edge of the sheet is detected by a downstream sensor, the subroller is withdrawn from the bottom of the stack. As with U.S. Pat. No. 4,475,732 patent above, the operative principle is that the normal force against the stack is not maintained long enough to damage the sheet.

It is an object of the present invention to provide a self-adjusting friction feeder which automatically avoids the problems associated with an unsuitable amount of normal force applied to a sheet being separated.

It is another object of the present invention to provide a friction feeder which provides only the minimum necessary force required for a given type of sheet.

It is another object of the invention to provide a friction feeder which automatically adapts to whatever type of sheet is being used, without the need for external adjustments.

Other objects will appear hereinafter.

SUMMARY OF THE INVENTION

In accordance with the above objects, the present invention is an apparatus for feeding and separating sheets individually from a stack of sheets. A nudger is disposed adjacent to at least a portion of the stack, and a mechanism, including a rotatable friction feed belt thereon, is disposed adjacent a sheet on the stack to be fed. A variable normal force is provided between the nudger and the friction feed belt of the mechanism. A sensor detects a lead edge of a sheet at a preselected location relative to the mechanism, and the increase in the normal force between the mechanism and the nudger is stopped when the lead edge of a sheet is detected by the sensor.

In one embodiment of the invention, the nudger is a springably-mounted nudger ski, and the mechanism includes first and second rollers, about which the feed belt is entrained. The mechanism is associated with a cam which, when rotated, urges against an external surface which in turn causes the mechanism to be urged against the nudger ski. A ratchet-and-pawl arrangement maintains the cam, and thus the second roller, at the necessary constant position against the nudger ski, thus maintaining the necessary constant normal force.

In another embodiment of the invention, the mechanism is urged against the nudger ski by an externally-mounted cam which is rotated by a stepper motor.

In a preferred embodiment of the invention, the nudger is in the form of a pivotable nudger bumper which is urged against the stack of sheets while the mechanism is urged against the opposite side of the stack, to create the necessary normal force. The nudger bumper is urged toward the mechanism by means of a stepper motor input.

BRIEF DESCRIPTION OF THE DRAWINGS

While the present invention will hereinafter be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

FIG. 4 is a plan view showing the elements of another embodiment of the invention.

FIG. 5 is a plan view showing the elements of a preferred embodiment of the invention.

DETAILED DESCRIPTION OF THE INVENTION

Figure 1:
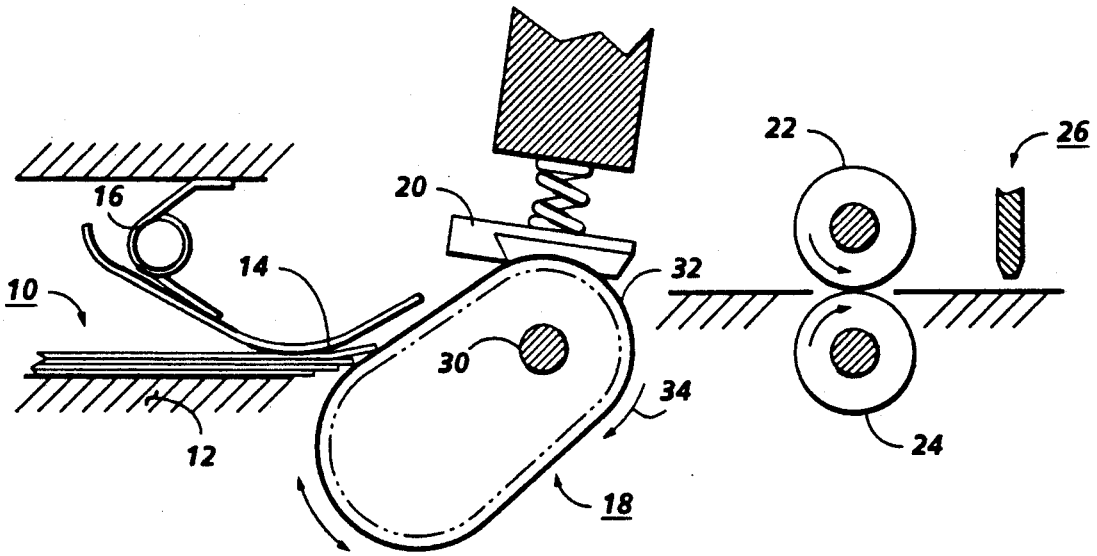
FIG. 1 is a plan view showing the elements of one embodiment of the present invention.

FIG. 1 shows the elements of the friction feeder of the present invention. A stack of sheets 10 is retained on a surface 12 for separation and feeding, for example, into a high-speed photocopier or facsimile machine. It will be understood that, although sheets 10 are called "sheets" and are by implication paper or card stock, the invention is not limited to use with paper products, and may be used to separate and feed any medium in sheet form, such as cellulose or plastic film. Similarly, surface 12 may be a part of any kind of storage box or hopper, as would vary with the specific design of equipment with which the present invention is being used.

Adjacent the stack of sheets 10 is disposed a nudger ski 14, which is springably mounted to a fixed surface by coil spring 16, and a mechanism generally indicated as 18, which will be described in detail below. Adjacent a portion of the mechanism 18 is a retard pad 20. On the side of the mechanism 18 opposite that of stack 10 are pick-up rolls 22 and 24, and a sensor generally indicated as 26.

Mechanism 18 communicates with a drive shaft 30, shown end-on in FIG. 1, which forms a first axis about which the entire mechanism 18 is rotatable. Rotational motion supplied through drive shaft 30 is also used by the mechanism 18 to rotate a feed belt 32 in the direction shown by arrow 34. Feed belt 32 is a large-area-solid-nip (LASN) feed belt, which combines the functions of a nudger roll and feed roll commonly found in friction feeders. It will be seen that, when feed belt 32 is rotated in the direction shown by arrow 34, a sheet having an edge in proximity to the edge of surface 12 will be contacted by the feed belt 32 when the mechanism 18 is urged toward the nudger ski 14. When feed belt 32 is rotated in the direction of arrow 34, the sheet will be drawn from the stack through the space between feed belt 32 and nudger ski 14.

The LASN feed belt 32 is preferably a stretch belt. Feed belt 32 can also be made of a rubber layer adhered or coated to a low-friction, wear-resistant belt, such as a thin electroformed nickel belt. Such a feed belt reduces the contact pressure on images to avoid image smear and offset smear on the back side of a contacting substrate. This type of feed belt is suitable for the other embodiments of the present invention as well, which will be described in detail below.

Once the first sheet, shown as the bottom sheet in FIG. 1, is drawn from the stack 10 by the mechanism 18, the sheet is guided over the top curve of feed belt 32 by retard pad 20. Retard pad 20 also functions to apply a high friction surface to the sheet, thus retarding forward motion of the rest of the sheets drawn into the nip between the retard pad and the feed belt as the first sheet is driven through the retard nip by the feed belt 32. The lead edge of the sheet is directed by the retard pad 20 toward pick-up rolls 22 and 24, which rotate against each other and serve to continue the motion of the sheet through the system. Slightly downstream of the pick-up rolls 22, 24 is a sensor 26, which is adapted to detect the presence of a leading edge of a sheet coming through the system. When the lead edge of a sheet is detected at the sensor 26, a control system, which will be described in detail below, causes the mechanism 18 to stop urging against nudger ski 14, while the rotation of feed belt 32 continues to draw the remainder of the first sheet from the stack.

The operative principle of the present invention is thus as follows. In operation, mechanism 18 is doing two things: first, the feed belt 32 is rotating about the outer perimeter (as shown in FIG. 1) of mechanism 18, and second, the mechanism 18 is itself rotating about the axis of drive shaft 30. The rotation of mechanism 18 itself causes the upper surface of a mechanism 18 to be urged against the nudger ski 14. As nudger ski 14 is springably mounted against a rigid surface (as, for example, by coil spring 16), the counteracting force provided by nudger ski 14 against the mechanism 18, which is the normal force against a sheet passing between the mechanism 18 and the nudger ski 14, will increase depending on how far the mechanism 18 is rotated against the nudger ski 14. Controlling the position of mechanism 18 relative to nudger ski 14 is thus the same as controlling the normal force against a sheet being separated from the stack 10.

In this way, when a new stack of sheets 10, of unknown weight and surface characteristics, is loaded onto surface 12, mechanism 18 will rotate against nudger ski 14 while feed belt 32 rotates about mechanism 18. As mechanism 18 rotates, the counteracting force from nudger ski 14 will progressively increase until the first of the sheets is successfully drawn from the stack 10. The amount of force provided at that moment is therefore the minimum necessary normal force for feed belt 32 to draw the successive sheets by friction.

Figure 2:
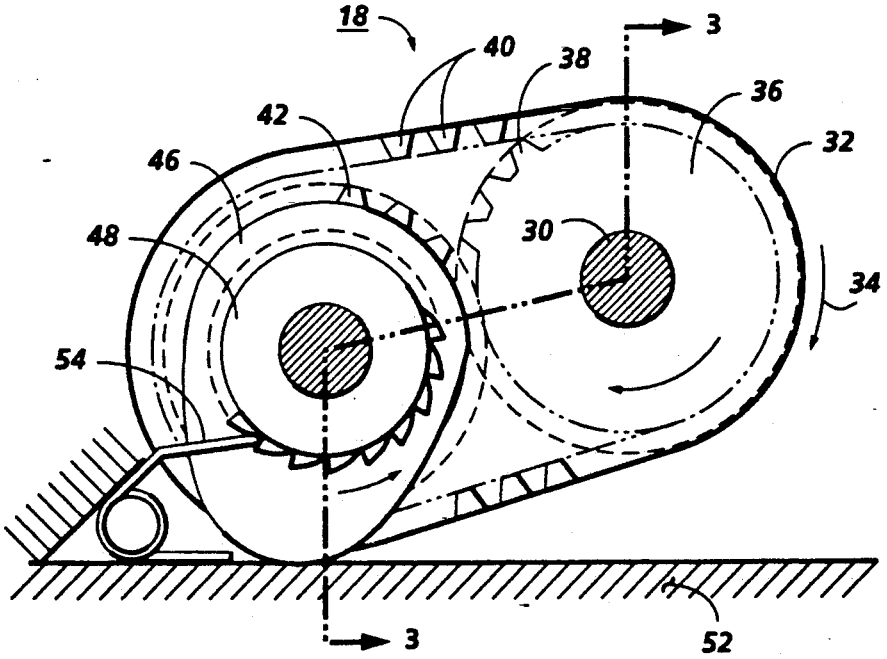
FIG. 2 is a cross-sectional view showing the mechanism of the belt support of the embodiment of the present invention shown in FIG. 1.
Figure 3:
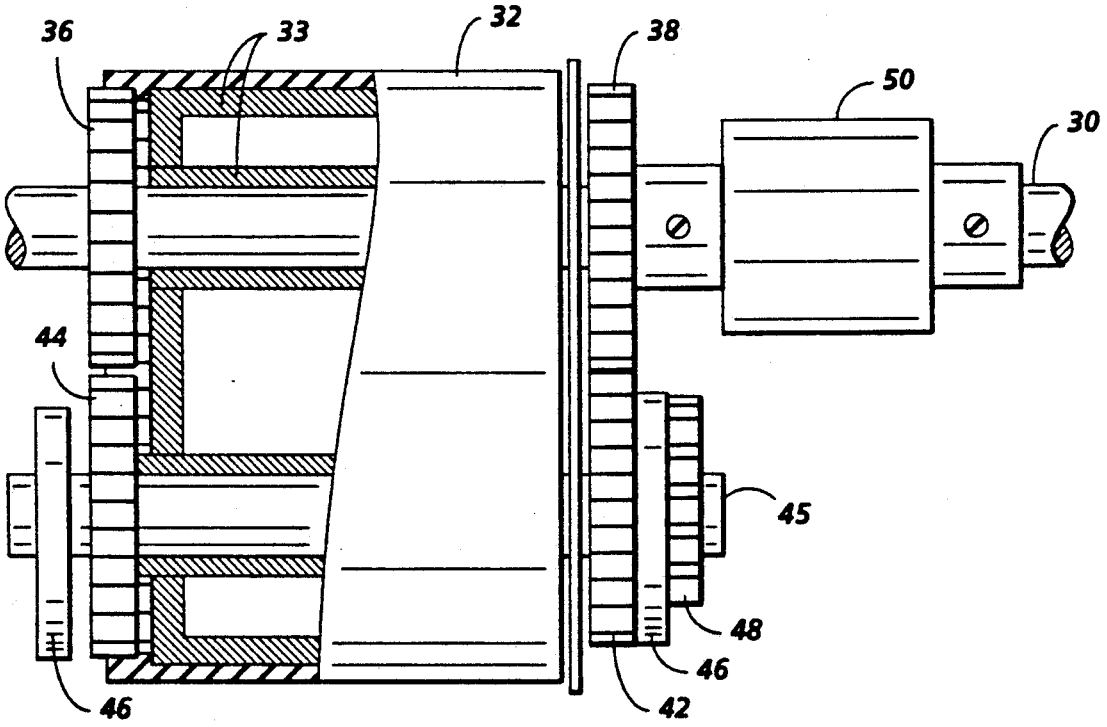
FIG. 3 is a partial cross-sectional view through line 3—3 in FIG. 2.

One simple construction of mechanism 18 is illustrated in FIGS 2 and 3. Drive shaft 30, through which is provided the rotational motion for both feed belt 32 and mechanism 18 itself, drives a first roller 36. First roller 36 is entrained with a second roller 44, which is mounted on shaft 45, by the feed belt 32, thus forming the characteristic elongated shape of mechanism 18 shown in FIG. 1. The feed belt 32 is mounted over a low-friction support core 33, around which the feed belt 32 may easily slide, and which also provides a support and bearing surfaces for drive shaft 30 and shaft 45. The feed belt 32 may include on its inner surface teeth 40, which may interact with teeth in rollers 36 and 44 to avoid slippage of the feed belt 32. A gear 38 is concentric with, but rotates independently of, the first roller 36. Gear 38 meshes with a second gear 42, which is preferably concentric with cam 46 and mounted therewith on shaft 45.

The mechanism 18 may be controlled through a clutch 50. As those skilled in the art will recognize, clutch 50 may be adapted to provide rotational motion to two concentric but independent shafts, thereby allowing gear 38 to rotate independently of first roller 36. Alternatively, clutch 50 may selectively control gear 38 only, while the shaft rotating roller 36 may be part of a main drive of a larger system. Alternatively, rotation of gear 38 may be provided by an external gear (not shown) which engages the teeth of gear 38. Typically, though not necessarily, roller 36 will rotate continuously while the system is operating, while gear 38 will rotate only as needed at the beginning of a run of feeding a stack of sheets.

Second gear 42 is part of a cam assembly which further includes cam 46 and ratchet wheel 48. These three parts move as one, and are preferably formed as a single plastic piece. The cam assembly may also include a second cam, such as that shown as 46' in FIG. 3, on the opposite side of mechanism 18. This cam assembly causes the rotation of mechanism 18 against nudger ski 14.

As seen most clearly in FIG. 2, rotation of gear 42 causes the lobe of cam 46 to urge against an adjacent fixed surface such as 52. Because mechanism 18 is rotatable about the axis of drive shaft 30, the action of cam 46 will cause the end of mechanism 18 to move upward, that is, against the nudger ski 14 in FIG. 1. At the same time, the ratchet wheel 48 rotates, interacting with pawl 54 to maintain a particular position of the cam 46. Ratchet wheel 48 and pawl 54 are arranged so that the cam 46 can rotate in one direction only, which is usually the direction of more rotation against the nudger ski 14.

Returning to FIG. 1, at the point in the cycle of use when the first sheet is successfully drawn from the stack 10, and the appropriate amount of normal force for the stack 10 is thus determined, the first sheet is drawn over the mechanism 18 and then picked up by pick-up rolls 22, 24, which continue the motion of the sheet through the system. Just downstream of pick-up rolls 22, 24 is a sensor 26, which is adapted to detect the lead edge of a sheet passing through the system. This lead-edge detection may be accomplished by any number of means well-known in the art, such as, but not limited to, electric eye detection.

When the lead edge of the first sheet from stack 10 is detected at the sensor 26, a control system (not shown), which may be embodied in a mechanical linkage, electronic hardward, or software, causes the clutch 50 to disengage gear 38, which in turn causes the further rotation of mechanism 18 against nudger ski 14 to stop. The mechanism 18 will thus be locked by the ratchet wheel 48 and pawl 54 in the position consistent with the minimum necessary normal force to separate and feed the remaining sheets in the stack 10.

At the end of a run (the separating of a stack of sheets), the position of the mechanism 18 may be reset by temporarily re-engaging the clutch 50 so that gear 38 and thus cam 46 will make a near-complete rotation to withdraw mechanism 18 from the nudger ski 14. This re-setting may be initiated in any number of ways, such as a reset button on the equipment, or an automatic reset triggered by detection of no further sheets on surface 12.

While the embodiment of the invention shown in FIGS. 1–3 has the advantages of simplicity of design, manufacture, and operation, the present invention may be embodied in other forms in order to be coordinated with the design of other components of the system. For example, instead of mounting the cam directly on the mechanism itself, to be urged against an external surface, the mechanism may be urged against the nudger ski by means of a cam mounted external to the mechanism. FIG. 4 shows an alternate embodiment of the present invention, similar in many of its elements to the embodiment of FIGS. 1–3, but wherein the mechanism 60 (which is equivalent in function to the mechanism 18 of FIGS. 1–3) is urged against nudger ski 14 by an external cam 62, which contacts cam follower 64, rigidly mounted on the mechanism 60. In this embodiment, cam 62 is rotated around shaft 66 by a stepper motor (not shown). The stepwise rotation of cam 62 causes mechanism 60 to urge against nudger ski 14 in a stepwise fashion, thus increasing the normal force against a sheet being fed in stepwise fashion.

When the first sheet in a stack 10 is fed between the nudger ski 14 and the rotating belt 32 on mechanism 60, cam 62 is rotated in a stepwise fashion until the normal force between mechanism 60 and nudger ski 14 is sufficient to feed a sheet through. The belt 32 is rotated by drive shaft 30, which is driven continuously (at least in the course of feeding one sheet) by the main drive of the system. This embodiment thus requires two separate rotational inputs, a stepper motor input at shaft 66 and a continuous input through drive shaft 30. The coordination of these different rotational inputs is preferably performed at a software level in the control system. When the run of feeding a stack of sheets is over, the cam 62 may be reset by a partial rotation, so as to disengage the mechanism 60 from the nudger ski 14.

This embodiment preferably includes, in addition to the sensor 26 discussed in connection with the previous embodiment, a second sensor 68, disposed even further downstream of the mechanism 60 (the take-away rolls 22, 24 may be located as needed downstream of the mechanism relative to the sensors 26, 68). Both sensors 26 and 68 act as lead-edge detectors for the first sheet in the stack 10 to pass through the system. The closer sensor, 26, is arranged with the control system to prevent a further increase in normal force, by stopping further motion of the cam 60 when the lead edge of the first sheet in stack 10 is detected downstream of the mechanism 60. The second sensor 68, in contrast, is arranged with the control system to move the cam 62 so as to release the normal force between the mechanism 60 and nudger ski 14 when the lead edge of a sheet being fed is detected at second sensor 68. The use of two sensors 26, 68 enables the cam 62 to operate in a "rise-hold-reverse" pattern for each sheet passing through the system, which will be explained in further detail in conjunction with a preferred embodiment of the invention.

In a preferred embodiment of the invention, the mechanism is urged against a nudger bumper which itself provides an active force against the sheets being fed, instead of the urging the mechanism against a passive, spring-loaded nudger ski, as in the embodiments described above. FIG. 5 shows an embodiment wherein mechanism 80 (which, again, is functionally equivalent to the mechanisms 18 and 60 described above) receives one rotational input through drive shaft 30, which causes rotation of the feed belt 32, and a stepper motor input to a cam 82. Cam 82 is disposed within a cavity, or track slot, 84 defined inside the mechanism 80. When cam 82 is rotated, the lobe of cam 82 pushes against the track slot 84, thereby urging at least one end of mechanism 80 against stack 10. As in the above embodiments, the greater the rotation of the cam 82, the greater the displacement of the mechanism 80, and the greater the normal force.

Opposite the mechanism 80, on the other side of stack 10, is a nudger bumper 86, mounted on a pivotable nudger bumper support 88. The nudger bumper 86 is preferably a hollow member made of a flexible plastic. Nudger bumper support 88 receives a stepper motor input which causes a stepwise increase in the normal force exerted by the nudger bumper 86 on the stack 10. The normal force of the nudger bumper 86 is complementary to the normal force from the mechanism 80, and together nudger bumper 86 and mechanism 80 create a clamping motion against the entire stack 10 or at least a portion thereof. The stepper motor inputs to the cam 82 and the nudger bumper support 88 may be directly related, for example by connecting both to a single stepper motor, such as by a gear mechanism (not shown). As in the previous embodiments, the normal force, here provided by both the mechanism 80 and the nudger bumper 88, is progressively increased until the first sheet is successfully drawn off the stack. The normal force then remains at this sufficient value for the rest of the sheets on the stack. This embodiment also includes a spring-loaded retard ski 20, take-away rolls 22, 24, and sensors 26 and 68, which here operate just as they do in the previous embodiments.

Among the advantages of this particular embodiment is that the nudger bumper 86 can provide a controlled normal force against the entire stack of sheets 10, regardless of the size of the stack. If a passive spring is used against the stack in a sheet-feeding context, the size of the stack will effect the displacement of the spring, and therefore the normal force from the spring will decrease as the stack decreases in size.

The embodiments of the invention shown in FIGS. 4 and 5 herein are particularly conducive to active control of the normal force on the sheet in the course of feeding a stack of sheets and in the course of feeding each sheet. The normal forces can be controlled with great precision by computer manipulation of the stepper motor driving the mechanism and the nudger bumper. For example, the cam 62 (in FIG. 4) or cam 82 and nudger bumper support 88 (in FIG. 5) can be controlled to perform a "rise-hold-reverse" motion with the feeding of each sheet. At the beginning of each feed, the cam 82 (looking at FIG. 5) starts at a home position, in which no normal force is exerted on the stack by the mechanism 80 or by the nudger bumper 86. To feed a document, the cam 82 and nudger bumper support 88 begin to move so as to increase the normal force against the stack, and thus to the sheet on the stack to be fed. This motion of the cam 82 and nudger bumper support 88, which results in an increasing normal force, continues until a sheet is drawn off the stack 10 and the lead edge of the sheet is detected at sensor 26. When the lead edge of the sheet has been detected, the cam 82 and nudger bumper support 88 are held in position, resulting in a constant normal force. Finally, when the lead edge of the sheet is detected at sensor 68 and the sheet is being moved mainly by the take-away rolls 22, 24, the cam 82 and nudger bumper support 88 turn in a reverse direction, relieving the normal force. (This motion can also be performed, to a less exact extent, by the apparatus of FIG. 4, although the rise-hold-reverse motion will of course be performed by the cam 62 only.) The rise-hold-reverse cycle is repeated for each individual sheet, as opposed to the mechanism of FIGS. 1–3, where the normal force determined by the first sheet in the stack is maintained for the whole stack.

It should be added that the various features of the different embodiments may be combined in different permutations than those shown in the drawings; for example, the nudger bumper of the preferred embodiment may conceivably also used with a mechanism found in one of the other embodiments, and the mechanism of the preferred embodiment could conceivably be used in conjunction with a spring-loaded nudger ski.

Figure 6:
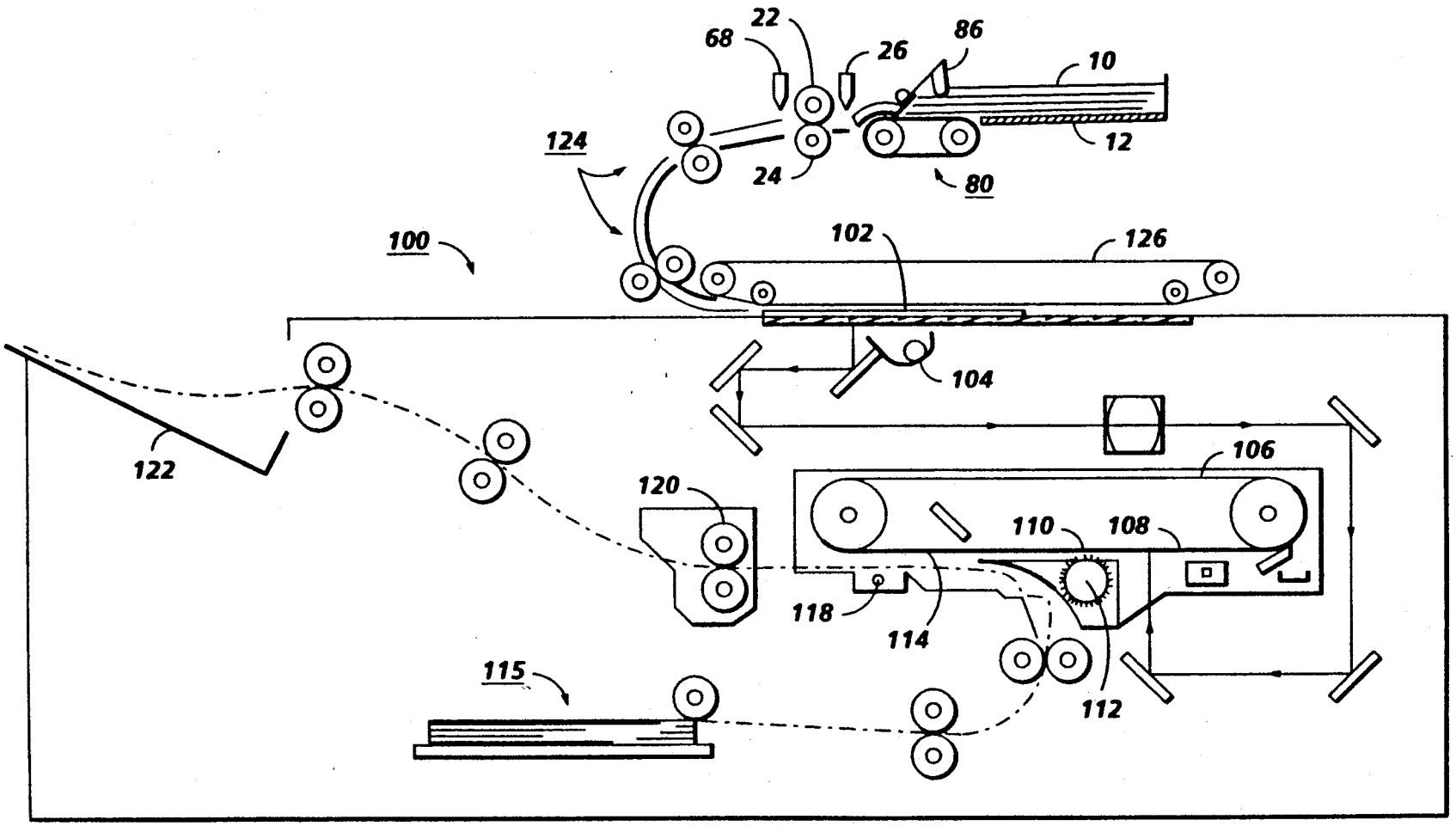
FIG. 6 is a simplified schematic view of an electrophotographic apparatus employing the present invention as a document feeder.

FIG. 6 shows the friction feeder of the present invention (specifically, the friction feeder shown in detail in FIG. 5, although any embodiment of the invention shown in the present application may, of course, be used in this context) as a document feeder for a typical electrophotographic printer, in this case a photocopier 100. In photocopier 100, a document to be reproduced is placed on a platen 102 where it is illuminated in known manner by a light source such as a tungsten halogen lamp 104. The document thus exposed is imaged onto the photoreceptor belt 106, as part of a xerographic process which will be familiar to those skilled in this art.

An image developed on photoreceptor belt 106 is transferred at the transfer station 114 from the photoreceptor belt 106 to a sheet of copy paper, which is delivered into contact with the belt 106 in synchronous relation to the image from a paper supply system, shown generally as 115. From the paper supply system 115, individual sheets of copy paper are separated from a stack and moved by means of an arrangement of nip rollers through the path indicated by the broken line, to transfer station 114. At transfer station 114, a transfer corotron 118 provides an electric field to assist in the transfer of the toner particles from the photoreceptor belt 106 to the copy sheet. The image is subsequently fused onto the paper in known manner at fusing station 120 and the finished copy is deposited in hopper 122. Although FIG. 6 shows the friction feeder of the present invention in the context of a photocopier, it wll be understood that the friction feeder of the present invention may be incorporated into any apparatus wherein individual sheets are separated from a stack.

In FIG. 6 can be seen the stack of original documents to be copied 10 disposed on surface 12, as part of a document feeder for the photocopier 100. The top sheet of the stack 10 is brought as required, into feeding engagement with the mechanism 80, as described above. A single separated sheet is then moved from the mechanism 80 through rollers 22 and 24, and past sensors 26 and 68, as explained above. The separated sheet is then passed through a series of rollers 124 and then applied to the platen 102 for copying, by means of a feeder belt 126, which may be operated in any manner known in the art.

When used in this context, the friction feeder of the present invention provides numerous advantages over prior art devices. The fact that the friction feeder is self-adjusting allows automatic feeding of originals of many types of paper to be fed into the machine, without the operator having to make manual adjustments. If the friction feeder readjusts the normal force on the stack with each sheet, the apparatus will be capable of feeding a heterogeneous mix of different types of originals, such as sheets of relatively rough bond paper mixed with relatively slick magazine paper, in a single run. Because many problems of misfeeding and multifeeding are the result of improper amounts of normal force against the stack, a copier incorporating the present invention can reasonably be expected to be more reliable than prior-art equipment.

As would be apparent to one skilled the art, a friction feeder mechanism as described herein may also be used for the feeding of copy sheets into photocopier 100 or other electrophotographic apparatus, such as at paper supply system 115 in photocopier 100. The same principles that apply to original documents to be copied can be applied to the blank copy sheets which make up the paper supply for an apparatus.

In addition to the above-mentioned advantages, the present invention reduces or eliminates many practical problems associated with prior art sheet-feeding devices. Because there is no speed difference between the nudger and the retard pad, their combined normal forces contribute fully and positively to the total drive force, enabling the use of a lower normal force on the retard pad, and thus avoiding smearing. At the same time, the variable normal force between the mechanism and the nudger can compensate for the decrease in the friction coefficient caused by wear on the feed belt. The configuration of the feed belt enables the use of a thin rubber layer, which is preferable to a thick layer in the manufacturing process. The present invention is applicable to duplex and multiple sheet insertion systems, such as for feeding fused and fresh substrates with different frictional coefficients. Further, the present invention is easily incorporated in a clam-shell design, with the nudger ski and retard pad separable from the feed belt and mechanism. Finally, because the system is self-adjusting, it is reasonable to infer that more relaxed tolerances may be generally used.

While this invention has been described in conjunction with a specific apparatus, it is evident that many alternatives, modifications, and variations will be apparent to those skilled in the art. Accordingly, it is intended to embrace all such alternatives, modifications, and variations as fall within the spirit and broad scope of the appended claims.

What is claimed is:

1. An apparatus for feeding and separating sheets individually from a stack of sheets, comprising:

a nudger, disposed adjacent to at least a portion of the stack;

a mechanism, disposed adjacent a sheet on the stack to be fed, including a rotatable friction feed belt thereon, the mechanism and nudger being adapted for sheet feeding engagement of sheets from the stack;

urging means for providing a variable normal force against the portion of the stack between the nudger and the friction feed belt of the mechanism;

sensor means for detecting a lead edge of a sheet at a first preselected location relative to the mechanism; and control means, responsive to the sensor means, for causing the urging means to stop increasing the normal force against the stack between the mechanism and the nudger when the lead edge of a sheet is detected by the sensor means, and causing the urging means to maintain the last value of the normal force after causing the urging means to stop increasing the normal force.

2. An apparatus as in claim 1, further comprising a retard pad adjacent the friction feed belt.

3. An apparatus as in claim 1, further comprising pick-up rolls disposed adjacent the mechanism, being adapted for moving a sheet away from the friction feed belt.

4. An apparatus as in claim 3, wherein the pick-up rolls are disposed at a location farther from the mechanism than the first preselected location.

5. An apparatus as in claim 1, further comprising a second sensor means for detecting the lead edge of a sheet at a second preselected location, the second preselected location being located farther from the mechanism than the first preselected location, and wherein the control means is further adapted to cause the urging means to decrease the normal force between the mechanism and the nudger when the lead edge of a sheet is detected by the second sensor means.

6. An apparatus as in claim 5, further comprising pick-up rolls for moving a sheet away from the friction feed belt and the nudger, disposed between the first and second preselected locations.

7. An apparatus as in claim 1, wherein the urging means is driven by at least one stepper motor.

8. An apparatus as in claim 1, wherein the nudger includes a springably mounted nudger ski.

9. An apparatus as in claim 1, wherein the nudger includes a nudger bumper, the nudger bumper being engagable with at least a portion of the stack of sheets, and movable with the urging means to cause a clamping action between the nudger bumper and the mechanism.

10. An apparatus as in claim 9, wherein the urging means and the nudger bumper are driven by at least one stepper motor.

11. An apparatus as in claim 1, wherein the urging means includes:

a rotatable cam, disposed on the mechanism;

a fixed surface adjacent the mechanism, engagable by the cam; and means for rotating the cam so that the cam engages the fixed surface, thereby causing the mechanism to be urged against the nudger ski.

12. An apparatus as in claim 11, further including stop means for permitting motion of the cam in only one direction.

13. An apparatus as in claim 12, wherein the stop means includes a ratchet wheel, associated with the cam, and a pawl.

14. An apparatus as in claim 1, wherein the mechanism includes a cam follower thereon, and the urging means includes a rotatable cam adapted to engage the cam follower.

15. An apparatus as in claim 1, wherein the mechanism includes a track slot defined therein, and wherein the urging means includes a cam rotatable against the track slot, whereby rotation of the cam in one direction causes urging of the cam against the track slot and urging of the mechanism against the nudger.

16. A mechanism for use in a sheet feeding apparatus, adapted for selectable positioning between a nudger ski and an adjacent fixed surface, the mechanism and nudger ski being adapted for sheet feeding engagement with sheets in a stack, comprising:

a first roller, rotatable around a first axis;

a second roller, rotatable around a second axis;

a friction feed belt entrained about the first roller and the second roller;

a cam adapted to engage the fixed surface, thereby displacing the second roller relative to the fixed surface; and transfer means, for transferring rotational motion to the cam;

whereby, when the cam displaces the second roller relative to the fixed surface, the mechanism rotates around the first axis so that the second roller is urged against the nudger ski.

17. A mechanism as in claim 16, wherein the cam is rotatable around the second axis.

18. A mechanism as in claim 16, wherein the transfer means includes a first gear rotatable about the first axis, and a second gear rotatable with the cam.

19. A mechanism as in claim 16, further including stop means for permitting motion of the cam in only one direction.

20. A mechanism as in claim 16, wherein the stop means includes a ratchet wheel associated with the cam, and a pawl.

21. In an electrophotographic printer, an apparatus for feeding and separating sheets individually from a stack of sheets, comprising:

a nudger, disposed adjacent to at least a portion of the stack;

a mechanism, disposed adjacent a sheet on the stack to be fed, including a rotatable friction feed belt thereon, the mechanism and nudger being adapted for sheet feeding engagement of sheets from the stack;

urging means for providing a variable normal force against the portion of the stack between the nudger and the friction feed belt of the mechanism;

sensor means for detecting a lead edge of a sheet at a first preselected location relative to the mechanism; and control means, responsive to the sensor means, for causing the urging means to stop increasing the normal force against the stack between the mechanism and the nudger when the lead edge of a sheet is detected by the sensor means, and causing the urging means to maintain the last value of the normal force after causing the urging means to stop increasing the normal force.

22. An apparatus as in claim 21, further comprising a second sensor means for detecting the lead edge of a sheet at a second preselected location, the second preselected location being located farther from the mechanism than the first preselected location, and wherein the control means is further adapted to cause the urging means to decrease the normal force between the mechanism and the nudger when the lead edge of a sheet is detected by the second sensor means.

23. An apparatus as in claim 21, wherein the urging means is driven by at least one stepper motor.

24. An apparatus as in claim 21, wherein the nudger includes a springably mounted nudger ski.

25. An apparatus as in claim 21, wherein the nudger includes a nudger bumper, the nudger bumper being engagable with at least a portion of the stack of sheets, and movable with the urging means to cause a clamping action between the nudger bumper and the mechanism.

26. An apparatus as in claim 21, wherein the urging means and the nudger bumper are driven by at least one stepper motor.

27. An apparatus as in claim 21, wherein the mechanism includes a track slot defined therein, and wherein the urging means includes a cam rotatable against the track slot, whereby rotation of the cam in one direction causes urging of the cam against the track slot and urging of the mechanism against the nudger.

* * * * *